US006257403B1

(12) United States Patent
Feldmeier

(10) Patent No.: US 6,257,403 B1
(45) Date of Patent: Jul. 10, 2001

(54) PACKAGING SYSTEM FOR MEAL KIT

(75) Inventor: Daniel R. Feldmeier, Waunakee, WI (US)

(73) Assignee: Kraft Foods, Inc., Northfield, IL (US)

( * ) Notice: Subject to any disclaimer, the term of this patent is extended or adjusted under 35 U.S.C. 154(b) by 0 days.

(21) Appl. No.: 09/499,764

(22) Filed: Feb. 8, 2000

(51) Int. Cl.[7] ..... B65D 77/04
(52) U.S. Cl. ..... 206/217; 206/541; 229/904
(58) Field of Search ..... 206/217, 218, 206/541, 542, 545; 229/904; 426/120

(56) References Cited

U.S. PATENT DOCUMENTS

| | | | | |
|---|---|---|---|---|
| 1,818,908 | | 8/1931 | Pouchain et al. . | |
| 2,645,332 | * | 7/1953 | Martin et al. | 206/545 |
| 3,255,607 | * | 6/1966 | Bair et al. | 206/545 |
| 4,202,465 | | 5/1980 | McLaren | 220/468 |
| 4,314,650 | | 2/1982 | Cillario | 220/23.83 |
| 4,592,914 | | 6/1986 | Kuchenbecker | 426/107 |
| 4,708,248 | | 11/1987 | Davis | 206/549 |
| 4,889,239 | * | 12/1989 | Sandish et al. | 229/904 |
| 5,060,852 | * | 10/1991 | Beckerman et al. | 229/162 |
| 5,091,199 | | 2/1992 | Mally et al. | 426/120 |
| 5,167,973 | | 12/1992 | Snyder | 426/115 |
| 5,464,150 | | 11/1995 | Porres Sanchez et al. | 229/120.38 |
| 5,496,575 | | 3/1996 | Newarski | 426/115 |
| 5,501,338 | * | 3/1996 | Preston | 206/545 |
| 5,697,707 | | 12/1997 | Esposito | 383/38 |
| 5,727,679 | * | 3/1998 | Newarski | 426/120 |
| 5,747,084 | | 5/1998 | Cochran et al. | 426/120 |
| 6,048,558 | | 4/2000 | Feldmeier et al. | 426/120 |

OTHER PUBLICATIONS

U.S. Utility patent application No. 09/572,080—Rode et al., filed May, 17, 2000.
U.S. Utility patent application No. 09/573,019—Rode et al., filed May 17, 2000.

* cited by examiner

*Primary Examiner*—Jim Foster
(74) *Attorney, Agent, or Firm*—Fitch, Even, Tabin & Flannery

(57) ABSTRACT

A packaging system for a meal kit of ready to eat food and beverage items is provided to mechanically isolate the food items from the beverage container included in the meal kit. A method of assembling the food items and beverage container of the meal kit in the packaging system also is provided.

17 Claims, 5 Drawing Sheets

10
12
14
16
18
19
20
22
24
26
28
30
32
34
36
37
38
43
48

18
24
26
28
30
32

PACKAGING SYSTEM FOR MEAL KIT

FIELD OF THE INVENTION

The present invention relates generally to a packaging system for a meal kit that includes multiple, ready to eat food items and a beverage. In particular, the invention relates to a container that includes an outer carton and a removable inner carrier tray. The invention also relates to a method of assembling and packaging the food items and beverage container of the meal kit.

BACKGROUND OF THE INVENTION

Pre-packaged meal kits which include multiple food items that require a minimal amount of consumer preparation and allow for quick assembly of the food items have become increasingly popular. Generally, a meal kit contains various ready to eat food items to provide an essentially complete meal. Typical food items include farinaceous food products, meat products, cheese, sauces or dips, and dessert items.

The food items may be individually pre-packaged in film wrap, pouches or containers having removable lids. The consistency of certain of these food items is more delicate such that the food items may be easily crushed, crumbled or otherwise deformed. For example, chips may crumble into smaller pieces and breadsticks may be deformed by a heavy item placed on it. It is desirable to arrange the multiple, pre-packaged food items in a container in such a way as to limit movement of the food items during shipping and handling to prevent damage to the food items and improve the visual presentation of the meal kit. It is known to contain the food items in a main tray made of plastic, or other rigid material, and having one or more compartments. Such main trays provide a compact container for the various food items.

To provide a more complete and convenient meal kit, it is desirable to include a beverage with the food items. Packaging the beverage container, which may be larger and heavier than many or all of the food items, in the meal kit may be a problem. If the food items and beverage container are not contained in generally stable positions, the beverage container may damage the food items and may obstruct a consumer's view of the food items in the meal kit container. Thus, it is desirable to isolate the beverage container from the food items. Because of the larger size of the beverage container, it may not be feasible or economical, however, to provide a container having a separate compartment for the beverage container.

Moreover, certain food items, such as pizza crusts, breadsticks and nacho chips, also present packaging problems. These food items may be pre-packaged in larger-sized packages that are essentially as long and/or as wide as the meal kit container itself. As a result, it may be difficult, if not impossible, to utilize a multi-compartment container with such food items and still maintain the desired compact size of the container and overall meal kit.

There remains a need for a compact, compartmentalized packaging system for use with a meal kit that includes multiple, pre-packaged food items and a beverage container.

SUMMARY OF THE INVENTION

In accordance with the invention, there is provided a packaging system for a meal kit that includes multiple, prepackaged food items and a beverage container. The packaging system generally comprises an outer container and an inner, carrier tray having a single compartment and disposed within the outer container. One or more ready to eat food items are disposed in the inner carrier tray. These food items are arranged in one or more layers. A beverage container also is disposed within the outer container adjacent the inner carrier tray between a side wall of the inner carrier tray and an opposing side wall of the outer carton. The inner carrier tray mechanically isolates the food items from the beverage container when assembled within the outer container.

The outer container comprises generally upstanding front, back and first and second side walls, and the inner carrier tray comprises generally upstanding front and back walls and generally upstanding first and second side walls. The walls of the inner carrier tray may extend outwardly at an angle. The bottom wall of the carrier tray is generally planar and may include one or more cut outs for receiving food items. The carrier tray also may include legs or tabs extending downwardly from the bottom wall. The front wall, side wall and first side wall of the inner tray engagably contact the front, back and first side wall of the outer container to limit lateral movement of the inner carrier tray within the outer carton. The outer container further comprises a lid having at least one opening cut from the lid. The inner tray maintains the position of the food items and the beverage container relative to the openings in the lid to allow a consumer to view the food items and beverage container when the lid is in a closed position and the outer carton is sealed closed.

The invention further relates to a method of assembling a meal kit of ready to eat food and beverage items comprising individually packaging two or more ready to eat food items, assembling the food items in a carrier tray by arranging the food items in one or more layers within the carrier tray, providing an outer container having a lid, assembling a beverage container within the outer container, assembling the carrier tray with food items adjacent the beverage container, where the beverage container is disposed between and engagably contacting a wall of the carrier tray and an opposing wall of the outer container, and sealing the lid of the outer container.

DETAILED DESCRIPTION OF THE PREFERRED EMBODIMENT

Figure 1:
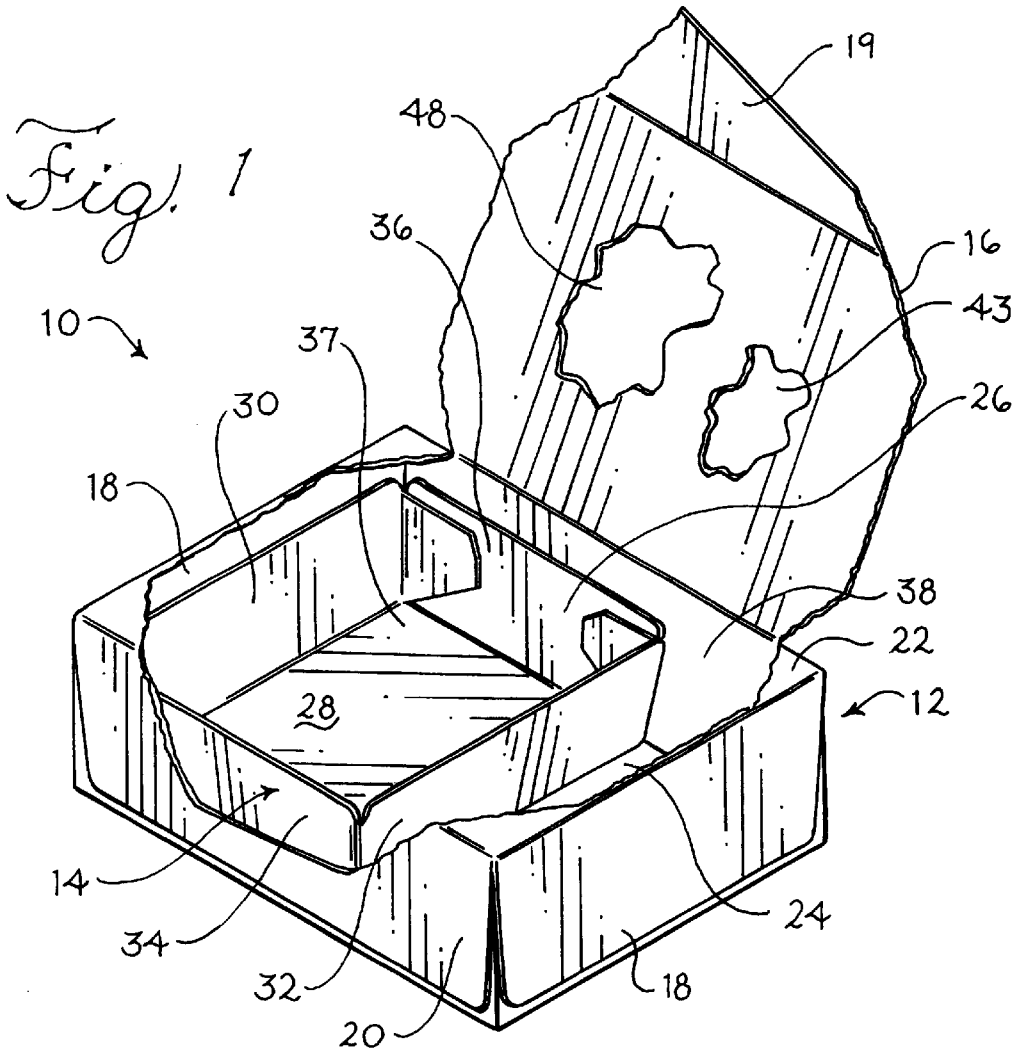
FIG. 1 is a perspective view of a container embodying the invention, with the lid of the outer carton open to show a carrier tray located within the outer carton.

The present invention generally is embodied in a packaging system 10 for a meal kit 11 of ready to eat food and beverage items. In the illustrated embodiment, as shown in FIG. 1, the packaging system 10 generally comprises an outer carton 12 and an inner carrier tray 14 removably disposed within the carton 12. The outer carton 12 is of a generally rectilinear construction and is formed of paperboard. The carton 12 has two side walls 18, front wall 20, back wall 22 and bottom wall 24. A lid 16 is pivotably moveable between open and closed positions along the intersection 25 of the lid 16 and the back wall 22.

The carrier tray 14 of generally rectilinear construction is disposed within the interior 26 of the carton 12 and provides two separate compartments 37 and 38 in the interior 26. As shown also in FIGS. 3 and 4, the open-top carrier tray has a planar bottom wall 28, side walls 30 and 32, and front and back walls 34 and 36. The dimensions of the carrier tray are smaller than those of the interior 26 such that when the carrier tray 14 is disposed in the carton 12, the two compartments 37 and 38 result. In this respect, the lengths of the side walls 30 and 32 are approximately the same as the lengths of the side walls 18 of the outer carton 12. The lengths of the front and back walls 34 and 36, however, are shorter than the lengths of the front and back walls 20 and 22 of the carton 12. The height of the walls of the carrier tray 14 also is shorter than the height of the walls of the carton 12 to provide clearance at the top of the carrier tray 14 with respect to the lid 16.

Figure 2:
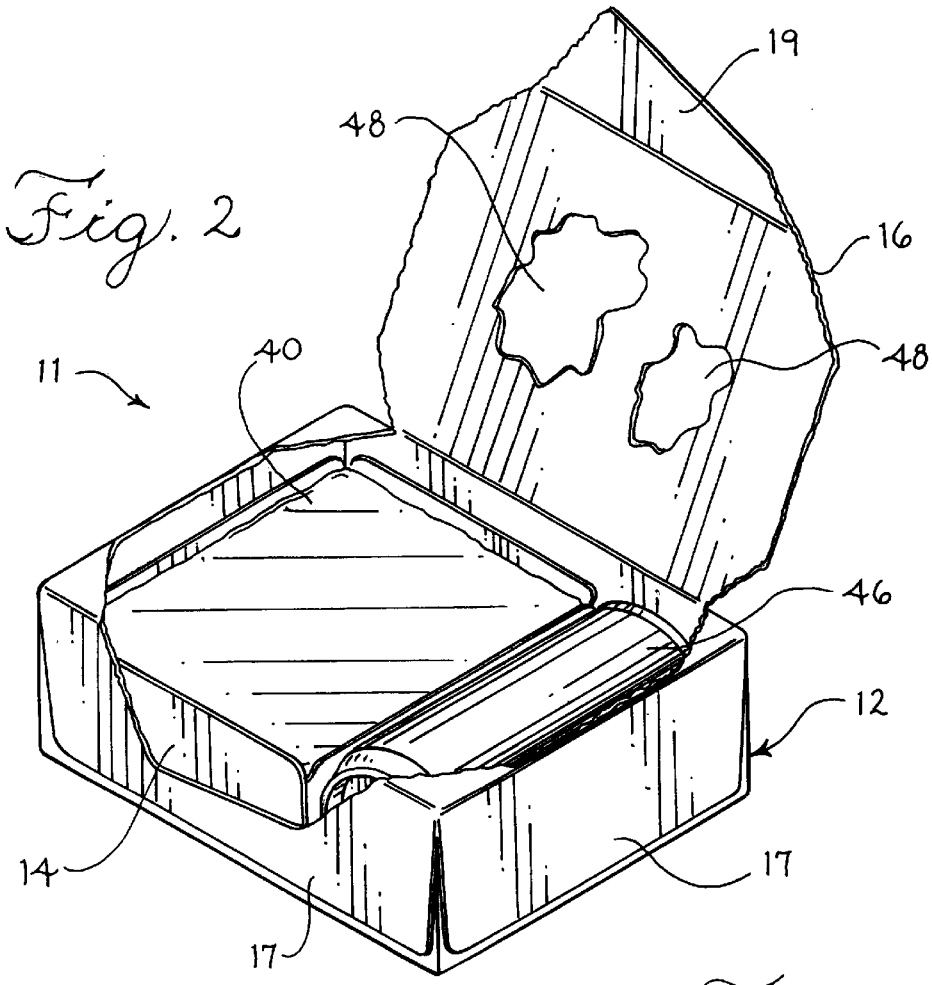
FIG. 2 is a perspective view of a meal kit in which food and beverage items are assembled within the container of FIG. 1.
Figure 3:
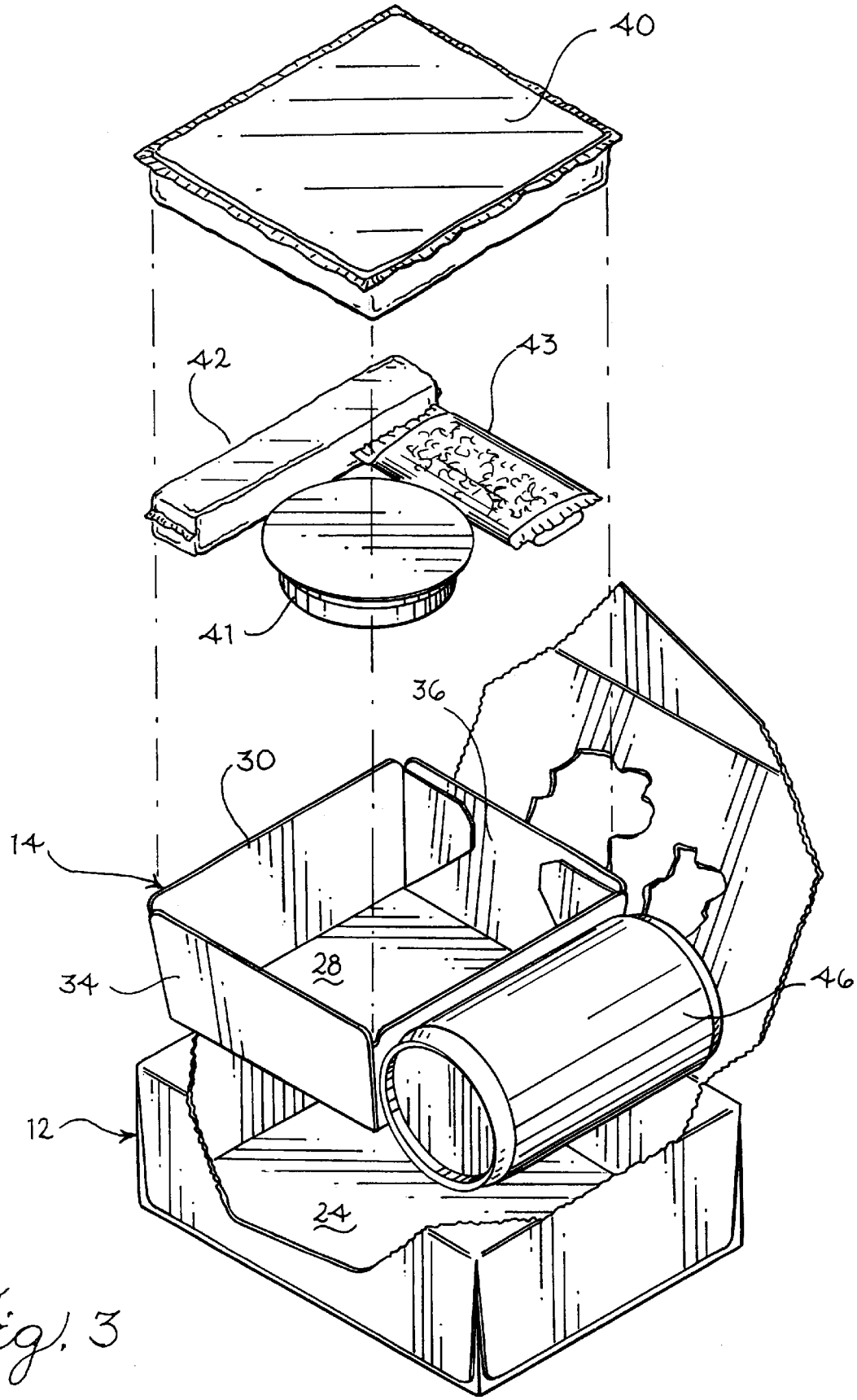
FIG. 3 is an exploded perspective view of the meal kit of FIG. 2.

As shown in FIGS. 2 and 3, the meal kit 11 generally includes at least two pre-packaged, ready to eat food items 40, 41, 42 and 43 and a beverage container 46. The food items may be packaged in pouches, wrapped in a film, contained in a cup having a removable lid or the like. The food items may include a farinaceous food, one or more sauces or dips, and a dessert food. Examples of farinaceous foods include bread sticks, pizza crusts, nacho chips and the like. Examples of sauces or dips include cheese sauce, salsa, pizza sauce and the like. Examples of dessert foods include candy pieces, cookies and the like. Other pre-packaged food items, such as shredded cheese and proteinaceous items (e.g., meat products), may also be included in the meal kit. The beverage container 46 may be a can of any chosen beverage, such as soda, juice or other drink, a box or plastic bottle of the chosen beverage and the like. If desired, other components may also be included in the meal kit. Such other components include, for example, utensils or other implements to assist with assembling the food items, spices, napkins and the like.

Figure 4:
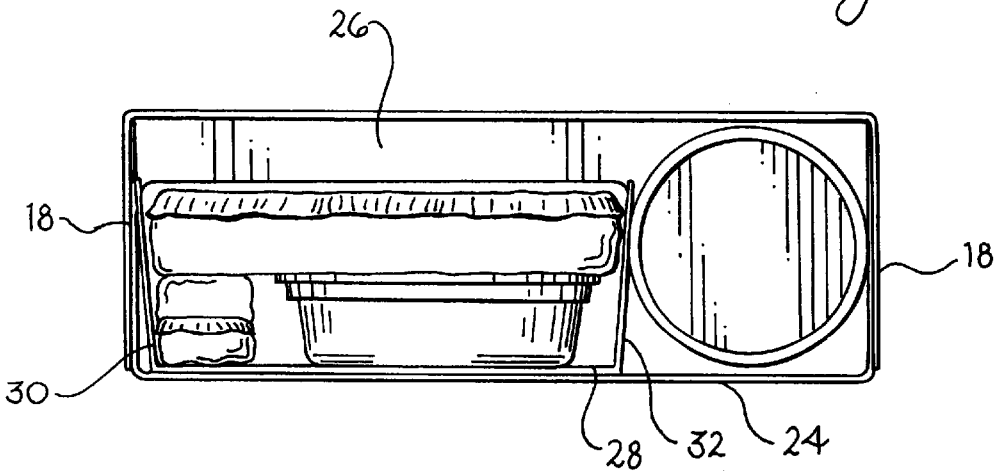
FIG. 4 is a front elevational view of the meal kit of FIG. 2 with the front wall of the outer carton and the front wall of the carrier tray removed to show the contents of the meal kit.

As also shown in FIG. 4, the carrier tray 14 rests on the bottom wall 24 of the carton 12, as does the beverage container 46. The food items 40, 41, 42 and 43 are disposed within the carrier tray 14 and are arranged in layers. The beverage container 46 is positioned adjacent the carrier tray 14 and is nested between the side wall 32 of the carrier tray 14 and the side wall 18 of the carton 12. In providing two compartments 37 and 38, the carrier tray 14 allows for separation of the food items 40, 41, 42 and 43 from the beverage container 46 within the carton 12. By mechanically isolating the food items 40, 41, 42 and 43 from the much heavier beverage container 46, the integrity of the food items, which typically are lighter and easily deformed or crumbled, may be better maintained. Shifting of the prepackaged food items 40, 41, 42 and 43 during shipping and handling of the meal kit 11 is thereby limited, as is rolling or other movement of the beverage container 46. Significantly, the upstanding side wall 32 of the carrier tray 14 between the food items and the beverage container prevents the beverage container from rolling on top of one or more of the food items.

Additionally, separating the food items 40, 41, 42 and 43 from the beverage container 46 and limiting their movement in the respective compartments 37 and 38 improves the presentation of the items contained in the meal kit 11. To allow a consumer to view the actual food items, the lid 16 may be provided with one or more cut outs 48. The cut outs 48 may be of any size, shape and orientation to allow a consumer to view at least the top layer of food items and the beverage container through the closed lid 16 without opening the carton 12. When the carton 12 is sealed closed, the carrier tray 14 helps to stabilize the food items and beverage container in position beneath cut outs 48 in the lid 16.

To provide two compartments 37 and 38 of appropriate dimensions, the carrier tray 14 is offset to one side of the carton 12. The front and back walls 34 and 36 of the carrier tray 14 engagably contact the front and back walls 20 and 22 of the carton 12, respectively, to limit transverse lateral movement of the carrier tray 14 within the carton 12. Preferably, one side wall 30 of the carrier tray 14 also engagbly contacts the corresponding side wall 18 of the carton 12. The beverage container 46 is disposed between, and engagably contacts, the opposite side wall 32 of the carrier tray 14 and the side wall 18 of the carton 12. Movement of both the carrier tray 14 and the beverage container 46 in a longitudinal direction within the interior 26 is limited.

The carrier tray 14 also may be used to support and contain the food items during preparation and consumption. The carrier tray 14 is removed from the carton 12 upon opening and the food items removed from the carrier tray 14. The food items may be assembled and prepared in the carrier tray 14 and may even be heated in a microwave in the carrier tray 14, if desired. The carrier tray 14 also serves as a container from which the food may be directly consumed. For example, in a pizza meal kit, the pizza crust is placed in the tray and the pizza sauce, cheese and other pizza ingredients are assembled on top of the crust. As another example, in a nachos meal kit, the chips are emptied into the carrier tray 14 and the cheese sauce is poured over the chips. In either example, the food may be heated in the carrier tray 14 using a microwave.

Figure 5:
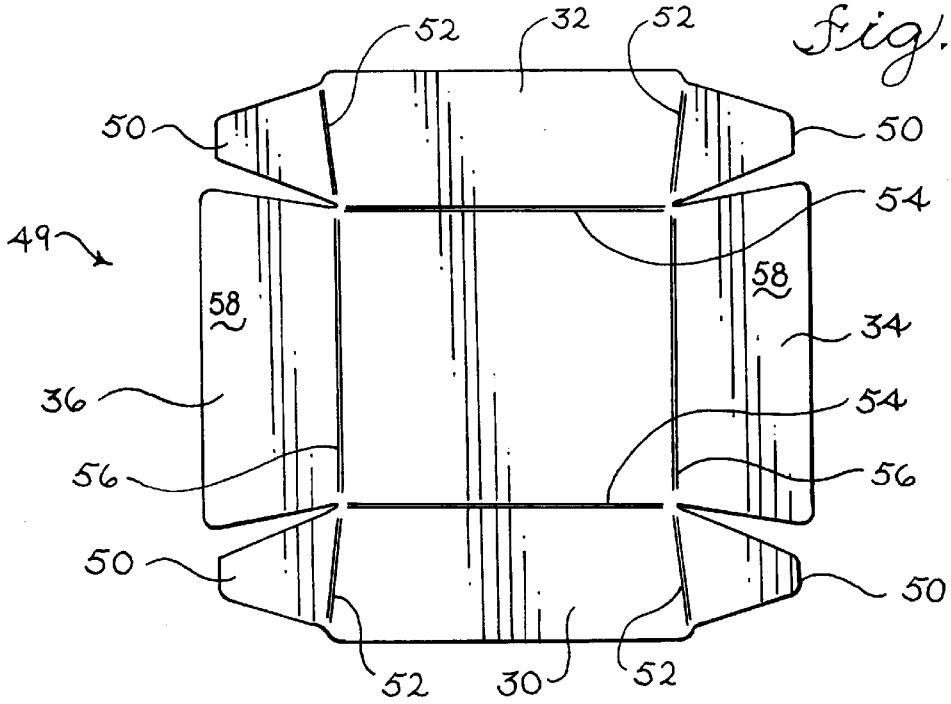
FIG. 5 is a top plan view of a blank from which the carrier tray of FIG. 1 may be formed.

Referring now also to FIG. 5, the carrier tray 14 may be formed from single, unitary paperboard blank 49. To erect the carrier tray 14 from the blank 49, side wall tabs 50 are folded upwardly along fold lines 52. The side walls 30 and 32 are then folded upwardly along fold lines 54. Next, the front and back walls 34 and 36 are folded upwardly along fold lines 56. Finally, the side wall tabs 50 are secured with adhesive or the like to the interior surface 58 of the front and back walls 34 and 36. This assembly provides a carrier tray 14 formed of a contiguous surface that will contain the food items, particularly sauces and dips, when the carrier tray 14 is utilized for preparation and eating of the food items.

The side walls 30 and 32 and the front and back walls 34 and 36 of the carrier tray 14 extend outwardly at an angle of at least about 0° to about 10° and preferably from about 5° to about 7° from a vertical plane. More preferably, the side walls extend at an angle of about 7° and the front and back walls extend at an angle of about 5°. When the meal kit 11 is assembled, at least a portion of the beverage container 46 preferably nests under the outwardly angling side wall 32.

The angling of the side walls also facilitates stacking (or nesting) of assembled carrier trays 14 within one another during storage prior to use in the meal kit 11.

The blank from which the carrier tray 14 is formed preferably is comprised of paperboard, and more preferably of solid bleach sulfate paperboard. Use of solid bleach sulfate paperboard for the carrier tray 14 limits odors (unpleasant or otherwise) that may result when the carrier tray is subjected to microwave heating. The paperboard has a clay coating on one surface, which, when assembled, is the interior surface of the carrier tray 14. The clay coating reduces absorption of moisture by the paperboard and reduces sticking of food items to the paperboard.

The paperboard preferably has a thickness of between about 0.016 and 0.022 inches, and more preferably of about 0.018 inches. The paperboard has a stiffness of at least about 160 Taber- MD or 87 Taber-CD, and more preferably at least about 200 Taber-MD or 108 Taber-CD. The basis weight is between about 160 and about 240 pounds per 3000 square feet.

The lid 16 of the carton 12 preferably is provided with conventional means for retaining the lid 16 in closed position, as well as to facilitate opening. The lid 16 also may be provided with conventional features to permit re-closing of the lid 16. Such means for closing the carton 12 may include securing flaps 17 on the lid to the walls 18 and 20 of the carton 12 with adhesive. Such means for opening may include providing a front flap 19 by which opening may be initiated and perforations along the lid 16 to complete opening. A tear strip, pull tab or the like also may be employed to facilitate opening.

Alternatively, the outer carton 12 and carrier tray 14 may be formed of other suitable materials such as a polymeric material or corrugated paperboard or cardboard, such as B flute corrugated.

The removable carrier tray 14 improves ease of assembly of the food items 40, 41, 42 and 43 and beverage container 46 in the carton 12 by allowing pre-assembly of the food items prior to final assembly of the meal kit 11. First, the food items 40, 41, 42 and 43 are individually pre-packaged. The carrier tray 14 is assembled from the unitary paperboard blank 49. The outer carton 12 also is assembled.

Next, the packaged food items are arranged in one or more layers in the carrier tray. Preferably, the food items are arranged with the smaller packages and containers on the bottom layer(s) and the larger package containing the farinaceous food item on the top. This arrangement allows the farinaceous item to be viewed through the cut out 48 in the lid 16, as well as prevents smaller packages of food items from passing through the cut out 48.

Next, the carrier tray 14 containing the pre-assembled food items is assembled with the beverage container 46 within the outer carton 12. Preferably, the beverage container 46 is deposited in the outer carton 12 prior to, but no later than consecutively with, the carrier tray 14. Because the side walls 30, 32, 34 and 36 of the carrier tray 14 preferably angle outwardly, the carrier tray 14 preferably is positioned above or adjacent to the beverage container 46 as the carrier tray 14 and beverage container 46 are deposited in the outer carton 12. Such positioning prevents the beverage container 46 from catching on the top edge of the side wall 32 of the carrier tray 14.

Finally, after the various items are assembled in the outer carton 12, the lid 16 of the outer carton 12 is secured in a closed position with adhesive or the like.

Figure 6:
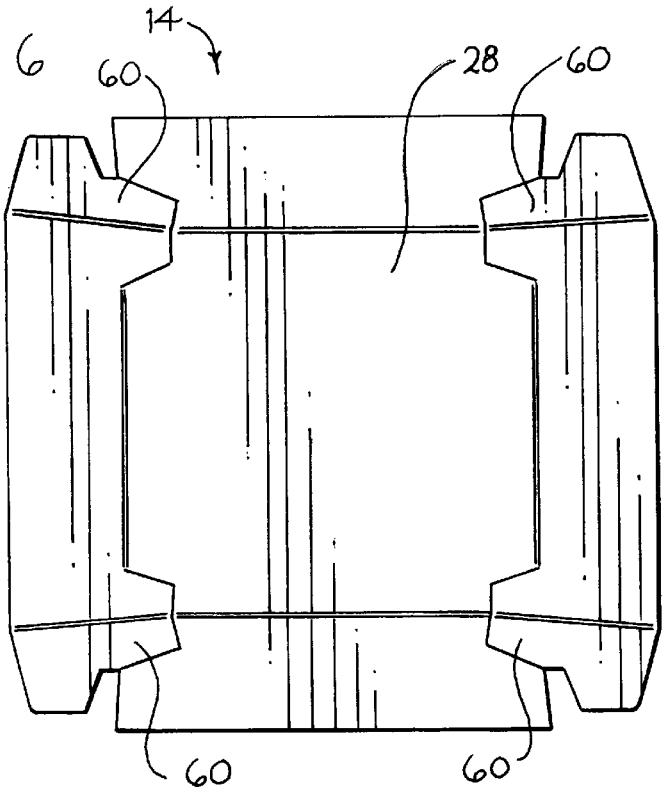
FIG. 6 is a top plan view of a blank for forming a carrier tray in accordance with a second embodiment of the invention.
Figure 7:
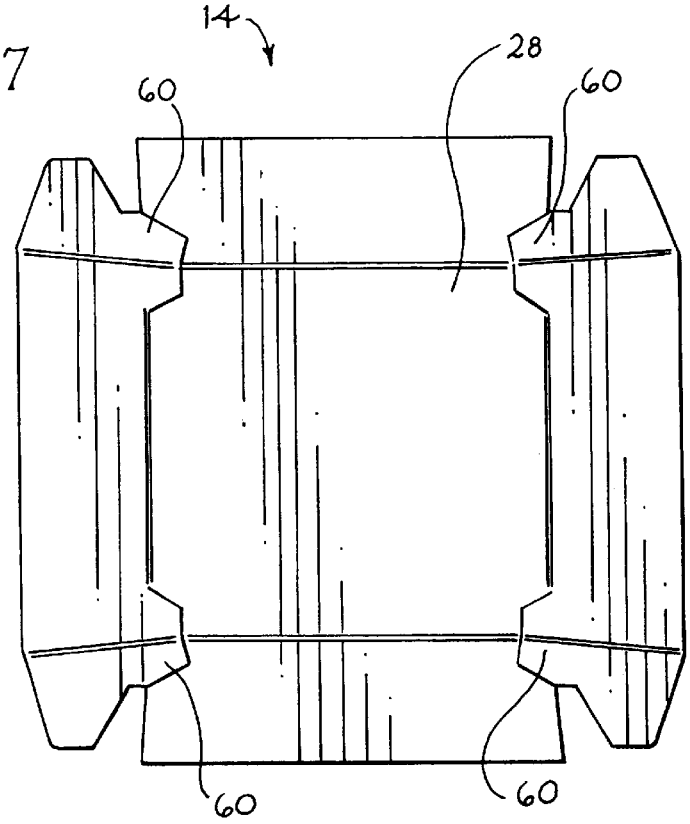
FIG. 7 is a top plan view of a blank for forming a carrier tray in accordance with a third embodiment of the invention.
Figure 8:
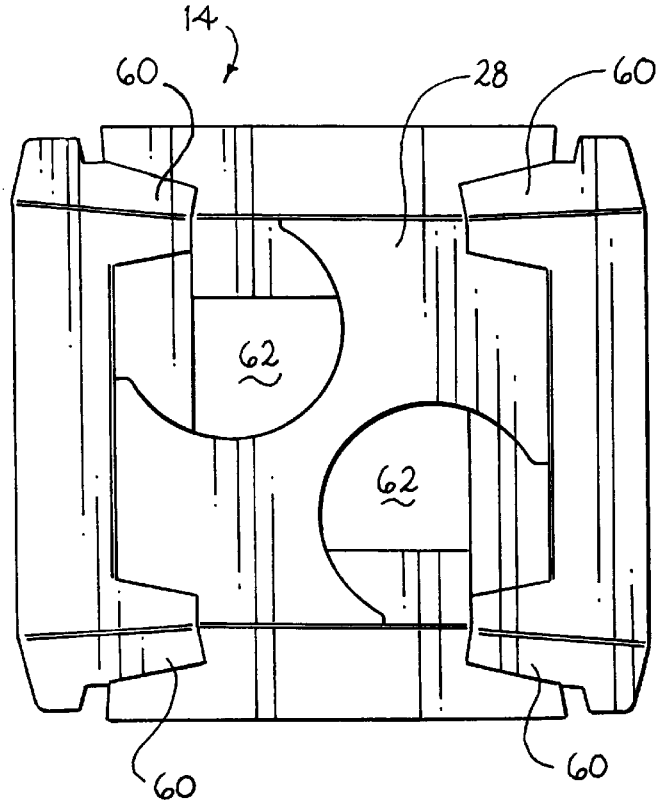
FIG. 8 is a top plan view of a blank for forming a carrier tray in accordance with a fourth embodiment of the invention.
Figure 9:
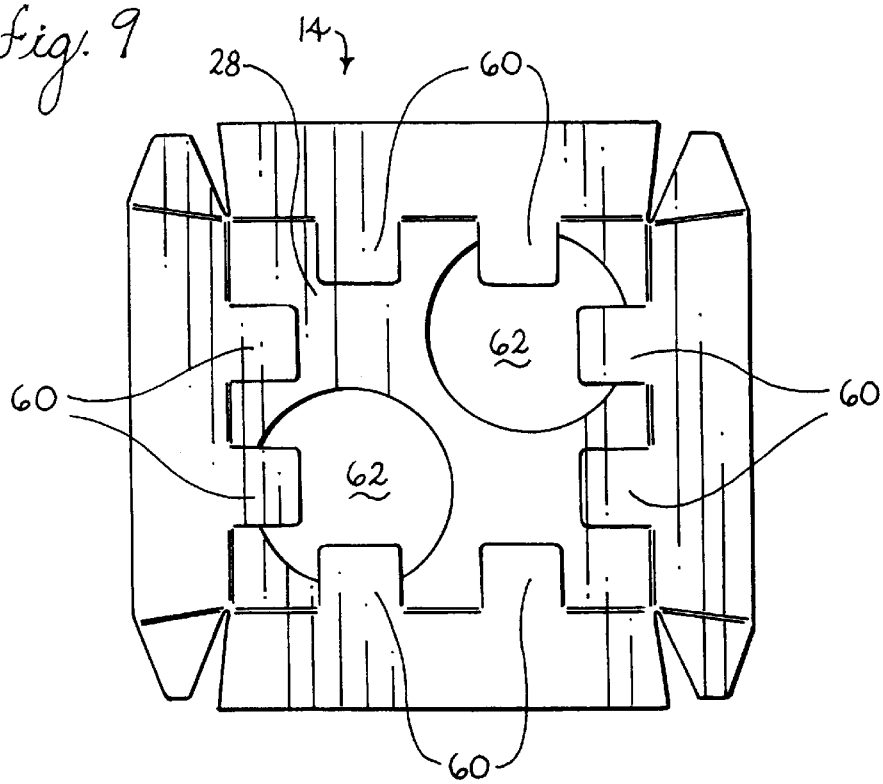
FIG. 9 is a top plan view of a blank for forming a carrier tray in accordance with a fifth embodiment of the invention.

Alternatively, as shown in FIGS. 7–9, the carrier tray 14 may include additional features. The carrier tray 14 may include tab-like legs 60 extending downwardly from the corners (FIGS. 6–8) or from one or more locations along the side walls (FIG. 9). The carrier tray 14 with legs 60 provides a raised bottom wall 28 beneath which food items or other components of the meal kit may be disposed. The raised bottom wall 28 also may make the food items more visible through the cut outs 48 in the lid 16 and may further secure the uppermost food item against the lid 16 to prevent smaller food items from passing through the cut out 48. The carrier tray 14 also may include one or more cut outs 62 at the bottom wall 28 for receiving food items (FIGS. 8–9). These cut outs 62 are configured to correspond to the shape of the packaged food item disposed therein to allow the packaged food item to be placed in the cut out 68.

Numerous alternatives, modifications and variations to the packaging system are possible to improve the assembly and packaging of a meal kit that includes multiple food items and a beverage container. Thus, modifications and variations in practice of the invention are expected to be apparent to those skilled in the art upon consideration of the foregoing detailed description of the invention. Although a preferred embodiment has been described above and illustrated in the accompanying drawings, there is no intent to limit the scope of the invention to this or any other particular embodiment. Consequently, any such modifications and variations are intended to be included within the scope of the following claims, which further describe and point out the invention.

What is claimed is:

1. A packaging system for a meal kit of ready to eat food and beverage items comprising:

a lightweight paperboard outer container having a bottom wall, a top wall and a plurality of side walls; and an inner paperboard tray having only one compartment said tray having a generally planar bottom surface disposed on the bottom wall of said outer container and disposed within said outer container, wherein a plurality of individually packaged ready to eat food items are disposed in said inner tray and a beverage container is disposed within said outer container adjacent said inner tray, and wherein said inner tray mechanically isolates said food items from said beverage container within said outer container.

2. A packaging system in accordance with claim 1 wherein said outer container comprises generally upstanding front, back and first and second side walls, wherein said inner tray comprises generally upstanding front and back walls and generally upstanding first and second side walls, and wherein said front wall, back wall and first side wall of said inner tray engagably contact said front wall, back wall and first side wall of said outer container to limit lateral movement of said inner tray within said outer container.

3. A packaging system in accordance with claim 2 wherein said inner tray limits lateral movement of said food items and said beverage container.

4. A packaging system in accordance with claim 3 wherein said side walls of said inner tray are disposed at an angle extending outwardly from said bottom wall.

5. A packaging system in accordance with claim 4 wherein said angle of said side walls is from about 0° to about 7° outwardly from a vertical plane.

6. A packaging system in accordance with claim 1 wherein said inner tray is removable from said outer container and usable for containing said plurality of food items during assembly and preparation of said food items.

7. A packaging system in accordance with claim 3 wherein said plurality of food items are preassembled in said inner tray prior to placing said inner tray within said outer container.

8. A packaging system in accordance with claim 3 wherein said outer container further comprises a lid having at least one opening and wherein said inner tray maintains the position of said food items and said beverage container relative to said at least one opening to allow viewing of said food items and beverage container by a consumer when the lid is in a closed position and said outer carton is sealed.

9. A packaging system in accordance with claim 3 wherein said plurality of legs of said tray extend downwardly from said side walls.

10. A packaging system in accordance with claim 9 wherein said inner tray further comprises a generally planar bottom wall having at least one opening for receiving a packaged food item.

11. A packaging system in accordance with claim 5 wherein said inner tray comprises paperboard.

12. A meal kit of ready to eat food and beverage items comprising:

an outer container;

an inner tray having one compartment with a generally planar bottom surface and disposed within said outer container;

a plurality of legs extending downwardly from said bottom surface of said compartment;

a plurality of individually packaged ready to eat food items disposed in said inner tray; and a beverage container disposed within said outer container adjacent said inner tray, wherein said inner tray mechanically isolates said food items from said beverage container within said outer container.

13. A meal kit in accordance with claim 9 wherein said food items are individually prepackaged and are arranged in layers within the inner tray.

14. A meal kit in accordance with claim 10 wherein said food items comprise a farinaceous food product.

15. A method of assembling a meal kit of ready to eat food and beverage items comprising:

individually packaging a plurality of ready to eat food items;

assembling said plurality of food items in a carrier tray by arranging said food items in one or more layers within said carrier tray, said carrier tray having one compartment for receiving said food items, said compartment having a generally planar bottom surface with a plurality of legs extending downwardly therefrom;

providing an outer container having a lid for securing said outer container in a closed position and for providing access to said food and beverage items;

assembling a beverage container within said outer container;

assembling said carrier tray containing said food items adjacent said beverage container, said beverage container disposed between and engagably contacting a wall of said carrier tray and an opposing wall of said outer container; and securing said lid of said outer container in a closed position.

16. A packaging system in accordance with claim 3 wherein said legs extend downward from said front and back walls.

17. A packaging system in accordance with claim 3 wherein said legs extend downward from corners formed between said side walls and said front and back walls.

* * * * *